US011208177B2

(12) United States Patent
January

(10) Patent No.: US 11,208,177 B2
(45) Date of Patent: Dec. 28, 2021

(54) ADJUSTABLE FLOTATION DEVICE

(71) Applicant: Greg A. January, Shawnee, KS (US)

(72) Inventor: Greg A. January, Shawnee, KS (US)

( * ) Notice: Subject to any disclaimer, the term of this patent is extended or adjusted under 35 U.S.C. 154(b) by 0 days.

(21) Appl. No.: 16/866,948

(22) Filed: May 5, 2020

(65) Prior Publication Data

US 2020/0354029 A1 Nov. 12, 2020

Related U.S. Application Data

(60) Provisional application No. 62/845,417, filed on May 9, 2019.

(51) Int. Cl.
*B63B 34/50* (2020.01)

(52) U.S. Cl.
CPC ..... *B63B 34/50* (2020.02)

(58) Field of Classification Search
CPC ..... B63B 34/50
See application file for complete search history.

(56) References Cited

U.S. PATENT DOCUMENTS

| | | | | | |
|---|---|---|---|---|---|
| 4,580,988 | A * | 4/1986 | Correll | A47C 15/006 | 114/123 |
| 5,176,554 | A * | 1/1993 | Simmons | A61H 37/005 | 441/129 |
| 5,186,667 | A | 2/1993 | Wang | | |
| 5,562,514 | A | 10/1996 | Rowe | | |
| 5,571,036 | A | 11/1996 | Hannigan | | |
| 5,685,753 | A * | 11/1997 | Canela | B63B 34/50 | 441/129 |
| 5,779,513 | A | 7/1998 | Burton et al. | | |
| 6,062,930 | A | 5/2000 | Smith | | |
| 6,086,150 | A | 7/2000 | Scheurer et al. | | |
| 6,887,186 | B2 | 5/2005 | Bambanian | | |
| 7,303,453 | B1 | 12/2007 | Bourke | | |
| 8,277,272 | B1 * | 10/2012 | Wemesfelder | B63C 11/49 | 441/129 |
| 8,795,015 | B1 * | 8/2014 | Nguyen | B63B 34/50 | 441/129 |
| 9,017,127 | B1 | 4/2015 | Callahan et al. | | |
| 9,051,032 | B2 * | 6/2015 | Hanel | B63B 34/50 | |
| 9,403,583 | B2 * | 8/2016 | Greenan | B63B 34/00 | |
| 9,775,439 | B2 * | 10/2017 | Rubey | A47C 4/28 | |
| 9,782,011 | B2 | 10/2017 | Liberatore | | |
| 10,023,274 | B1 | 7/2018 | George, II et al. | | |
| 2015/0197321 | A1 * | 7/2015 | Goldstein | A63H 23/10 | 441/129 |

(Continued)

OTHER PUBLICATIONS

TRC Recreation Pool Saddle Bahama Blue8590126; ebay; Mar. 12, 2019.

*Primary Examiner* — S. Joseph Morano
*Assistant Examiner* — Jovon E Hayes
(74) *Attorney, Agent, or Firm* — Erickson Kernell IP, LLC; Mark C. Young

(57) ABSTRACT

A flotation device includes a main body portion having a leg rest, seat, back rest, and headrest. Arms are adjustably attached to the back rest via hinge mechanisms which allow the arms to be pivoted towards and away from the main body portion, and which allow the length of the arms' extension from the main body portion to be adjusted. In alternative embodiments, cupholders are secured in apertures in the arms, with headrest extensions providing additional buoyance to the head rest portion.

13 Claims, 6 Drawing Sheets

(56) References Cited

U.S. PATENT DOCUMENTS

| | | | | |
|---|---|---|---|---|
| 2017/0273464 | A1* | 9/2017 | Aprin | A47C 1/146 |
| 2017/0341719 | A1 | 11/2017 | Bair et al. | |
| 2020/0354029 | A1* | 11/2020 | January | B63B 34/50 |

* cited by examiner

ADJUSTABLE FLOTATION DEVICE

CROSS-REFERENCE TO RELATED APPLICATIONS

This application claims the benefit of U.S. Provisional Patent Application No. 62/845,417, filed May 9, 2019, the disclosure of which is hereby incorporated herein in its entirety by reference.

BACKGROUND OF THE INVENTION

Field of the Invention

The present invention relates generally to flotation devices. More specifically, the invention relates to an adjustable flotation device for supporting a user in a sitting, partially reclined, reclined, or lying position.

Background & Description of the Related Art

Flotation devices are commonly used in recreational water areas such as pools, lakes, and the like. Various types of flotation devices are known, such as pool noodles comprising an elongated cylindrical foam that a user may lie or sit on, inflatable air mattresses and chairs which can support users in sitting or lying positions, and various other configurations for various uses. Particularly popular are lounge chair type flotation devices which allow a user to sit in an upright or inclined position, typically with their legs supported by at least a portion of the device.

However, such lounge chair type flotation devices are not without drawbacks. Inflatable devices generally position a user above the water, rather than in the water as is often desired by users. Such inflatable devices are also easily susceptible to damage and/or deflation, rendering the device unusable. Devices comprising lawn-chair like chairs with attached pieces of flotation material are bulky and heavy, making it difficult for users to transport and deploy the devices. Such known devices are also one-size-fits-all, with little or no accommodation for users of various sizes and proportions.

Thus, it can be seen that there remains a need in the art for a flotation device that supports a user in a desired position in the water and that is configurable to a user's size and proportions.

SUMMARY OF THE INVENTION

The present invention is directed to a flotation device for supporting a user in a sitting, partially reclined, reclined, lying, or other desired position while floating in a body of water. In one aspect, the flotation device includes a main body portion 11 comprising a leg rest, a seat, and a back rest, with a headrest extending upwardly from the back rest. First and second arms are pivotably attached to the back rest, allowing each arm to be pivoted toward and away from the main body 11. A plurality of apertures in the attachment end of each arm allow the effective length of the arm to be adjusted by attaching the arm to the back rest portion using a aperture closer to, or further from, the end of the arm.

In one exemplary embodiment, each arm includes a cup holder, each cupholder comprising a grommet portion for attaching the cupholder through an aperture in the arm, with a bag portion hanging below the grommet portion for supporting a cup, can, or drinking container. The grommet comprises upper and lower protrusions which secure the upper and lower edges of the grommet to the arm and prevent the grommet from being pulled through the arm.

In another embodiment, each hinge assembly comprises a hinge tube, with a receptacle and pin attaching a washer to the end of the tube. Each receptacle comprises a deflectable bayonet end that prevents the receptacle from being pulled from the hinge tube and secures the hinge assembly together. The washer positioned at each end of the hinge tube prevents the end of the hinge assembly from pulling through the foam of the arm and back rest which it attaches together.

In a further embodiment, the headrest comprises multiple layers that can be arranged to provide a desired level of flotation and comfort for a user.

DETAILED DESCRIPTION OF EXEMPLARY EMBODIMENTS

Figure 1:
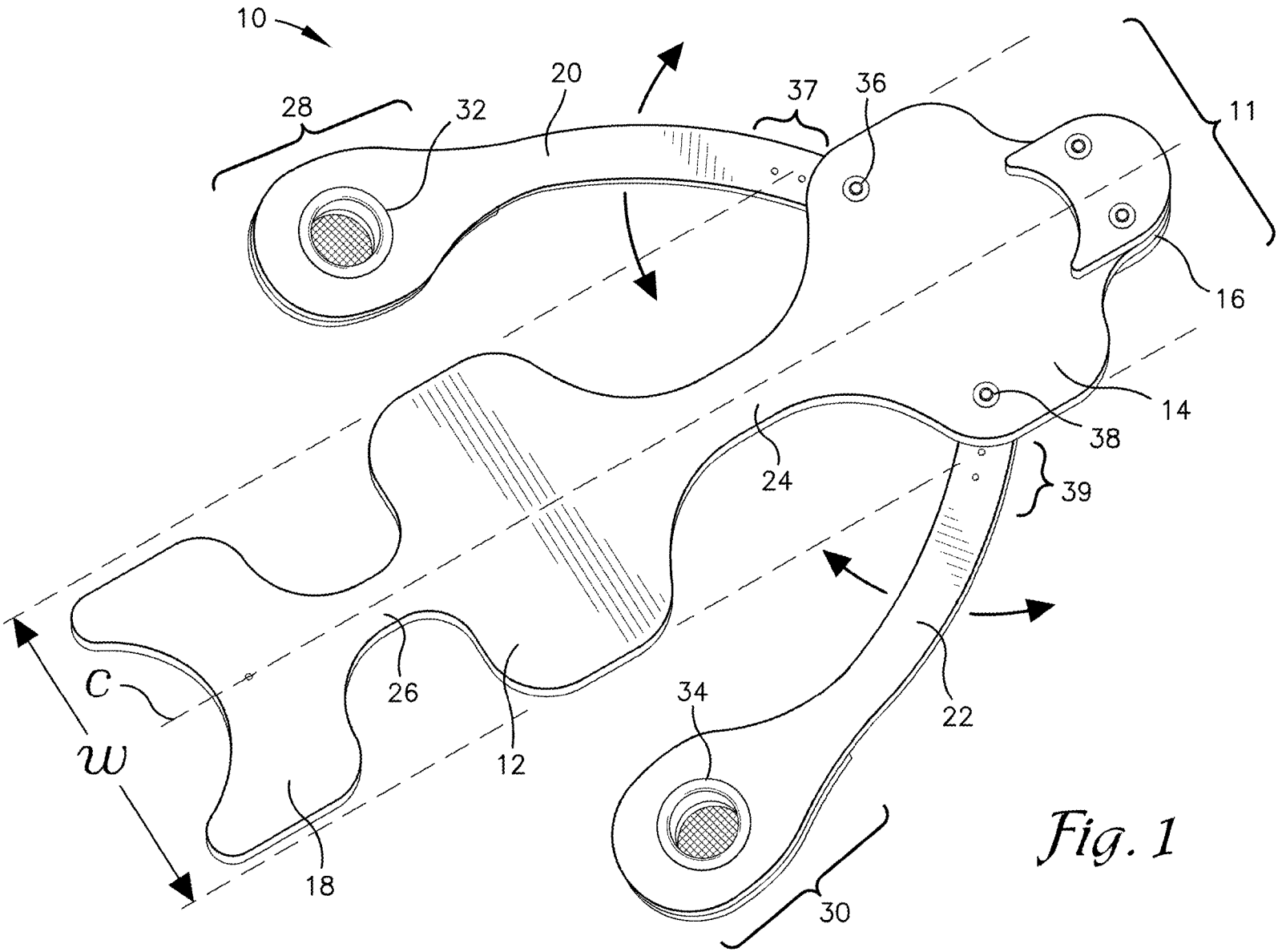
FIG. 1 is a top perspective view of a flotation device in accordance with an exemplary embodiment of the present invention.

Various embodiments of the present invention are disclosed herein, it is to be understood that the disclosed embodiments are merely exemplary of the invention, which may be embodied in various forms. Thus, any specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology used in the following description is for convenience in reference only and is not limiting. For example, the words "vertically", "horizontally", "vertical", "horizontal" and "upwardly", "downwardly", "upper", "lower" all refer to the installed position of the item to which the reference is made. The words "inwardly" and "outwardly" refer to directions toward and away from, respectively, the geometric center of the embodiment being designated and parts thereof. The terminology used herein may include the words specifically mentioned, derivatives thereof and words of a similar import. It is further understood that terminology such as the aforementioned directional phrases may be used to describe exemplary embodiments of the flotation device as shown in the figures herein. This is for convenience only as it is understood that the exemplary embodiments of the flotation device described may positioned other than as depicted in the drawings.

Looking first to FIG. 1, a flotation device in accordance with an exemplary embodiment of the present invention is referenced generally by the numeral 10. The flotation device generally comprises a seat 12, a back rest 14, a head rest 16, and a leg rest 18, with two arms 20, 22 extending outwardly from the back rest 14 along opposite sides of the seat 12. A first spine 24 extends between and connects the seat 12 and back rest 14, with a second spine 26 similarly connecting the leg rest 18 and seat 12.

Seat 12 is generally rectangular shaped, with rounded corners, and is configured to support the posterior portion of a user sitting on the seat 12 portion of the flotation device 10. Back rest 14 is similarly generally rectangular shaped, with rounded corners, and is configured to support the back, or upper back, portion of a user sitting on the seat 12 and reclining against the back rest 14. Leg rest 18 is a generally "C" shaped section configured to support the feet, calves or lower legs of a user sitting on the seat 12 portion of the flotation device. Leg rest 18, seat 12, and back rest 14 are of similar width w, with the leg rest 18 preferably being slightly narrower than the seat 12. First and second spines 24, 26 are of approximately equal width, with both being narrower than the leg rest 18, seat 12, and back rest 14 which they connect. As seen in FIG. 1, the leg rest 18, second spine 26, seat 12, first spine 24, back rest 14, and head rest 16 are aligned along a center axis c such that the entire body assembly of the flotation device is symmetrical about that center axis.

Leg rest 18, second spine 26, seat 12, first spine 24, back rest 14, and head rest 16 are preferably formed from a single piece of flat foam material such that the separate sections are formed by the integral contiguous piece. Most preferably, the foam material is 1.5 inch polyethylene foam, although other buoyant or floatable materials may likewise be used. In alternative embodiments the body of the flotation device may be comprised of separate sections that are joined or attached together rather than being formed from a single piece of buoyant material.

It should be understood that for illustrative purposes the flotation device 10 in FIG. 1 is depicted in a flat position. However, in use the flotation device will not be flat, as the weight of a user sitting on the device will submerge portions of the device into the body of water in which it is being used and will position the device into a chair-like shape. Thus, in one exemplary use, with the user in an upright sitting position, the seat 12 of the device will be submerged under the water due to the weight of a user sitting on the seat, with the first and second spines 24, 26 curving upwardly from the seat 12, with the back rest 14 and head rest 16 being inclined from a vertical position, conforming to the back of a user sitting on the device and reclining against the back rest, and with the leg rest 18 floating substantially horizontally, atop or partial submerged from the surface of the water, supporting the legs of a user and with the arms floating substantially horizontally near the surface of the water while supporting the arms of a user.

In other exemplary uses of the flotation device 10, such as a user in a reclined position, a partially reclined position, a lying position, etc. the various components will be positioned as necessary to support the user in that desired position, with the user's weight distribution influencing the relative positioning and/or submerging of the components, and the user's desired positioning of the adjustable arms further influencing the relative positions. In other exemplary uses, a user may lie on the flotation device 10 face down, with their chest supported on the back rest 14 and their lower torso and hips supported on the leg rest 18 and lower spine 26. Thus, the flotation device may be adapted by a user to any desired positioning.

Referring still to FIG. 1, elongated arms 20, 22 extend along opposite sides of the flotation device 10, with one end of each arm 20, 22 attached to the back rest 14 and the distal end of each arm 20, 22 extending past the seat rest 12. An enlarged end portion 28, 30 at the end of each arm provides a mounting surface for a cup holder 32, 34 at the distal end of the corresponding arm. A plurality of apertures 37, 39 at the attachment end of each arm 20, 22 allow the arm to be attached to the back rest 14, extending a predetermined distance from the back rest 14, via a hinge mechanism 36, 38 which connects through a hole in the back rest 14 and one of the apertures 37, 39 in the corresponding arm.

As seen in FIG. 1, with the arms 20, 22 attached to the back reset 14 via the corresponding hinge mechanism 36, 38, each arm may be pivoted inwardly (i.e., towards the center axis c of the flotation device) or outwardly (i.e., away from the center axis c of the flotation device), allowing a user to adjust the arm to a desired orientation with respect to the center axis. For example, a user sitting upright on the flotation device 10 may orient the arms 20, 22 inwardly (towards the center axis c) so that they may rest their arms extending forward of their sitting position, while a user lying back on the flotation device may position the arms 20, 22 outwardly, nearly perpendicular to the center axis c, so that the user may likewise extend their arms outwardly. Thus, the arms may be adjusted or pivoted to any desired position.

Using the plurality of apertures 37, 39 on each arm, a user may also adjust the relative length of the extension of the arm from the back rest 14. For example, attaching the arm using the hole closest to the attachment end of the corresponding arm 20, 22 provides the greatest extension of the arm from the back rest 14, while attaching the arm using the hole furthest from the attachment end of the arm provides the least extension of the arm from the back rest 14. Thus, a user may adjust the effective length of the arm as desired—i.e., by having more or less of the arm 20, 22 extend from the back rest 14. It should be understood that adjusting the effective length of the arms likewise affects the relative extension of the arm so that, for example, the arm may extend past the seat 12 when adjusted to be fully extended and may not extend past the seat 12 when adjusted to a shorter length. As can be seen, adjustment of the arm correspondingly adjusts the distance of the cup holder 32, 34 at the end of each arm. The adjustable length of the arms provides comfortable accommodation of users of various sizes and proportions in various desired inclinations and positions, and likewise allows adjustment of the distance of the cupholders 32, 34 from the user.

Figure 2:
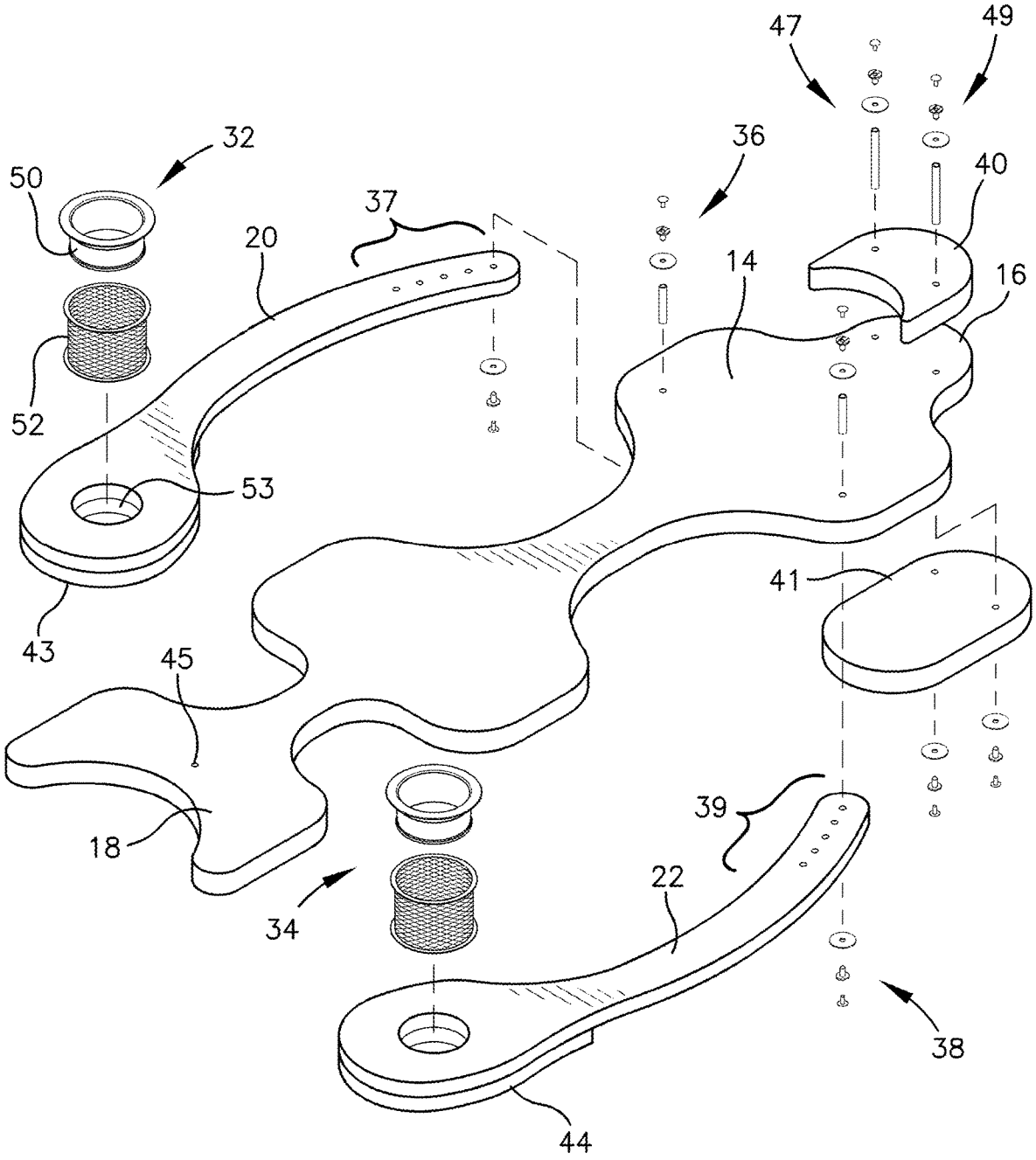
FIG. 2 is an exploded view of the flotation device of FIG. 1.

Looking to FIG. 2, an exploded view of the flotation device 10 of FIG. 1 provides a detailed view of the configuration and relationship of the arms 20, 22 and their attachment to the main body of the flotation device using the hinge assemblies via hinge assemblies 36, 38 as just described and referred to with respect to FIG. 1. Looking to FIG. 3, a detailed view of an exemplary hinge assembly such as hinge assemblies 36, 38 used to attach the arms 20, 22, to the back rest 14, is depicted generally by the numeral 200. It should be understood that the hinge assembly 200 corresponds to the hinge assemblies 36, 38 depicted in FIG. 1 as described above, used to attach the arms 20, 22 the back rest 14.

Figure 3:
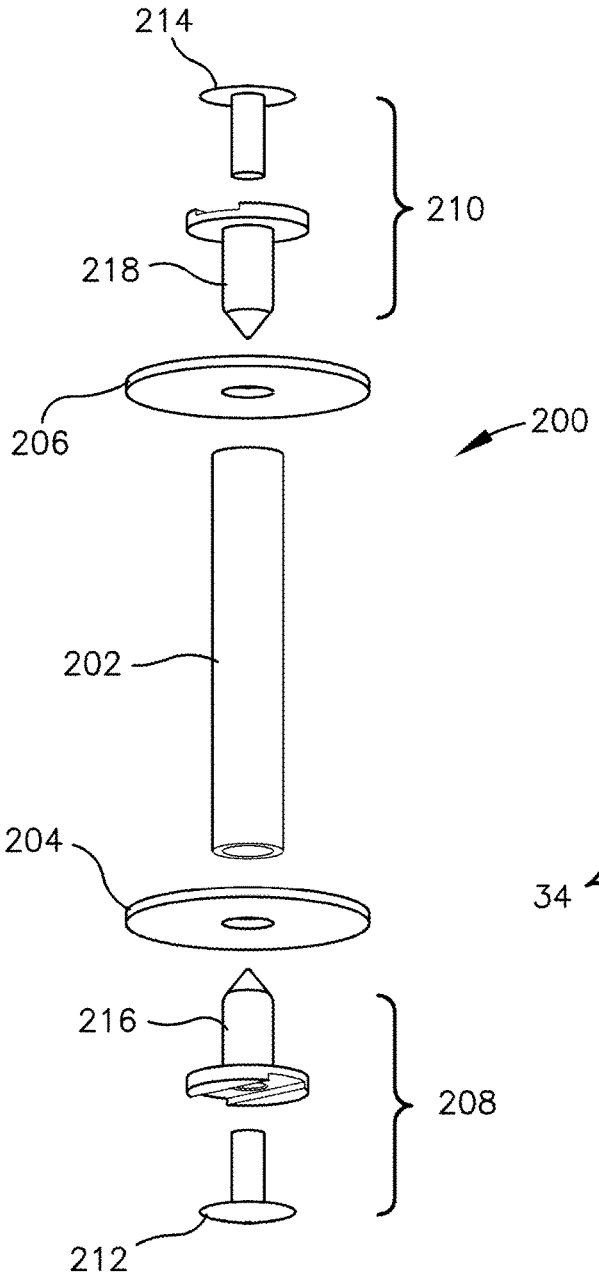
FIG. 3 is an exploded view of a hinge tube and attachment mechanism of the flotation device of FIG. 1.

As seen in FIG. 3, hinge assembly 200 comprises a hinge 202, first and second washers 204, 206, and first and second push retainers 208, 210. Hinge tube 202 is a cylindrical, hollow tube, preferably formed of a soft, deflectable material, such as vinyl, although any other known soft deflectable material may also be used.

First and second washers 204, 206 are shaped as conventional flat washers, having a circular shape with a circular aperture formed through the center. Preferably the washers are formed of a non-metallic material, such as a plastic or composite. Each push retainer 208, 210 is comprised of a pin 212, 214 and a receptacle 216, 218. Pins 212, 214 include a generally inflexible cylindrical rod extending from the bottom surface of a cap. Receptacles 216, 218 include a divided bayonet tip, with a cylindrical cavity formed between the halves of the bayonet such that inserting a pin 212, 214 into the cavity spreads or splays the halves of the bayonet tip apart. Thus, with a receptacle 216, 218 inserted into each of the opposite ends of hinge tube 202, a flat washer 206, 208 is placed over each receptacle and a pin 212, 214 is inserted into receptacle. With the pin inserted into the corresponding receptacle, the bayonet tips of the receptacles are spread or splayed outwardly away from each other and engage frictionally against the inner wall of the hinge tube 202. With the pin 212, 214 thus inserted, the bayonet tips of the receptacle are engaged against the hinge tube such that the receptacle cannot be removed, securing the hinge assembly together.

Looking back to FIGS. 1 and 2, the assembled hinge assemblies 36, 38 thus secure the arms 20, 22 of the flotation device to the back rest 14, allowing the arms to pivot about the tube of the hinge assembly while remaining securely attached to the back rest.

Figure 4:
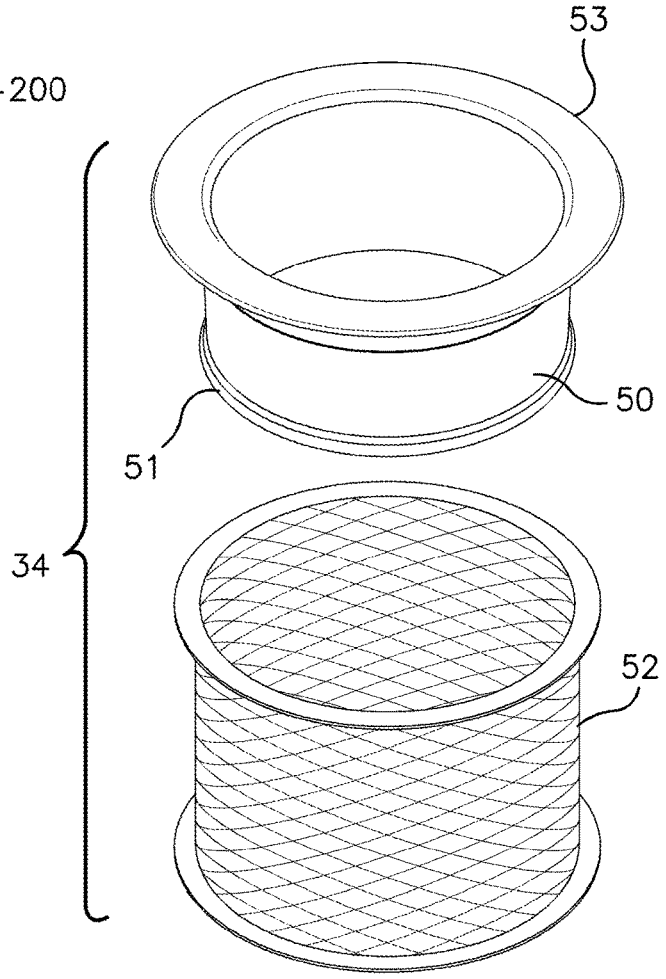
FIG. 4 is an exploded perspective view of a cupholder portion of the flotation device of FIG. 1.
Figure 5:
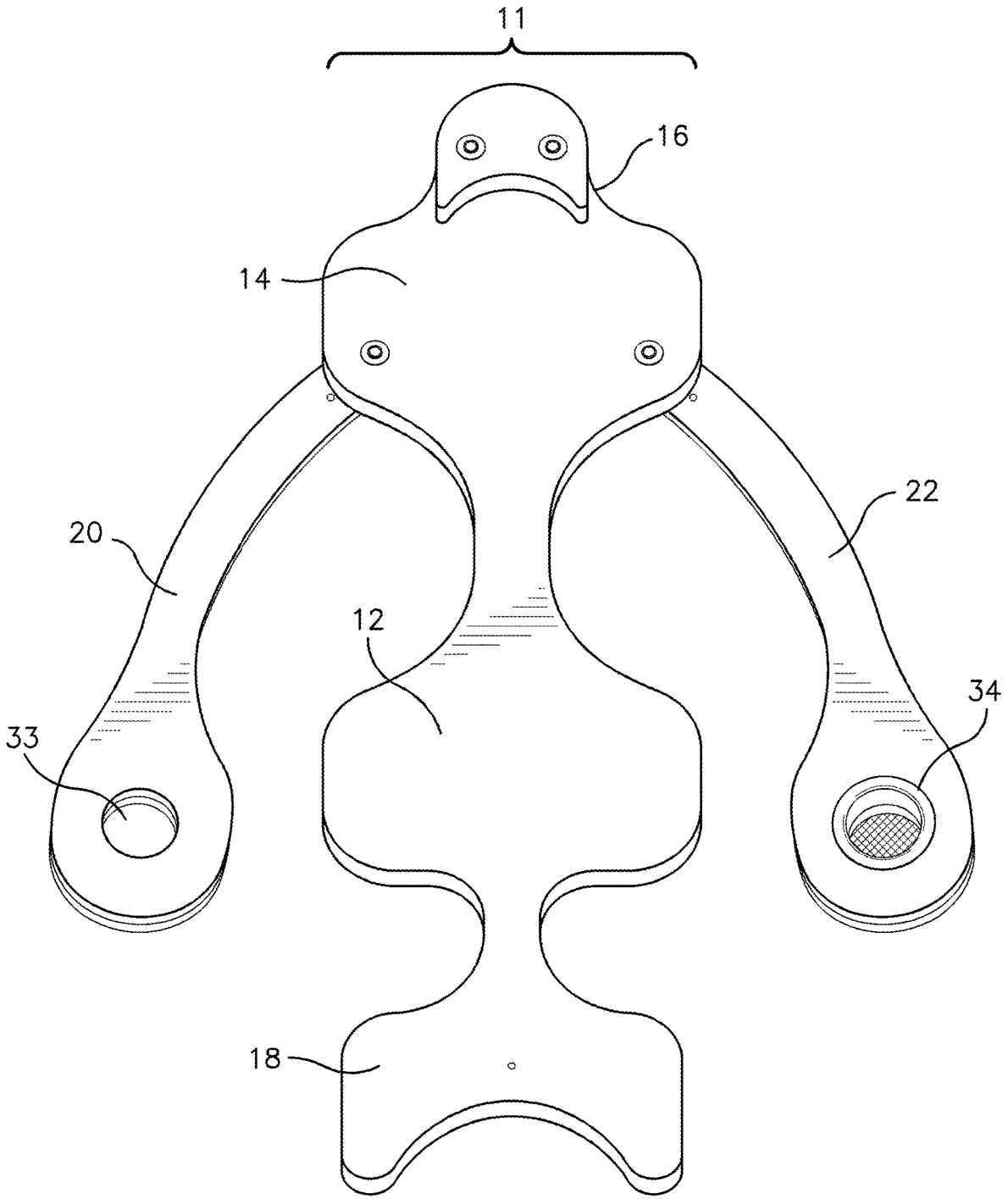
FIG. 5 is a top plan view of the flotation device of FIG. 1.

Looking to FIG. 4, an exploded view of one cupholder 32, 34 shows that the cupholder comprises a cylindrical grommet portion 50 with a bag 52 attached to and extending downwardly from the grommet portion 50, with a circumferential lip 51 around the bottom of the grommet portion 50 securing the bag 52 to the grommet 50, As seen in FIG. 5, an aperture 33 formed in the enlarged portion at the end of each arm 20, 22 provides for insertion of the grommet portion 50 to secure the cupholder 34 within the aperture. As best seen in FIG. 4, a protruding edge 53 at the top of the grommet portion 50 acts as a stop to prevent the grommet 50 from fitting entirely through the cupholder aperture 33, with the protruding lip 51 at the bottom edge of the grommet preventing the grommet 50 from pulling from the cupholder aperture, thus securing the grommet 50 and attached bag 52 within the aperture 33 in the arm.

Figure 6:
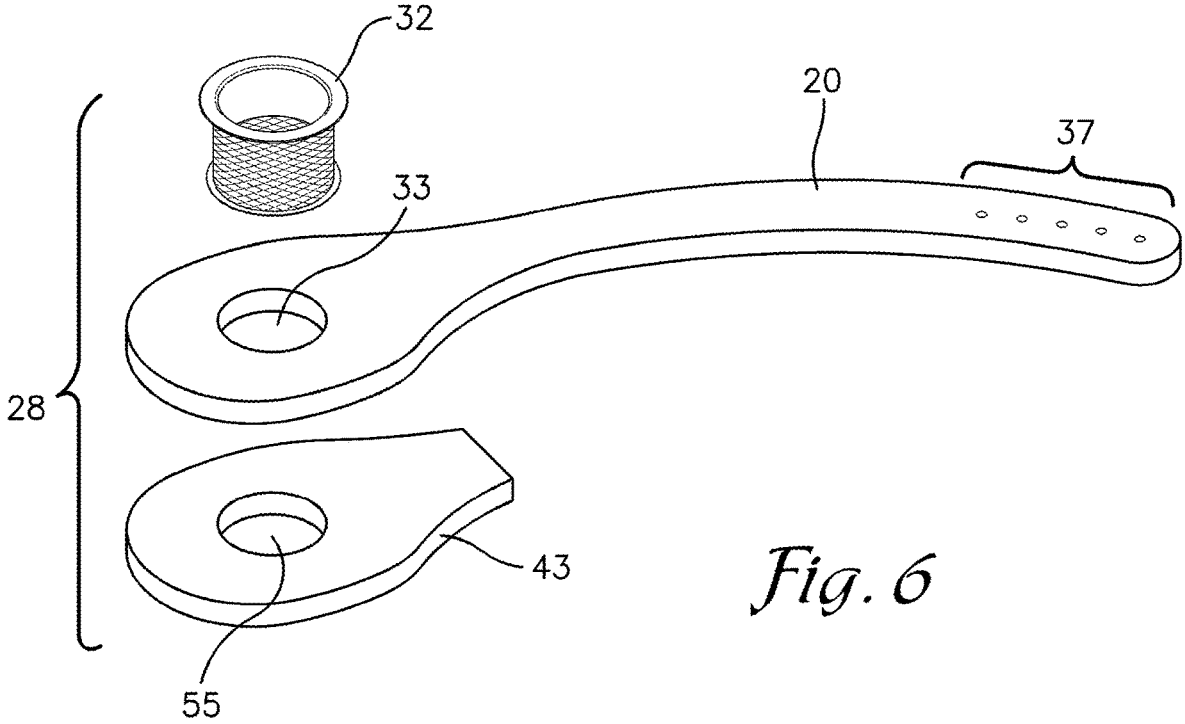
FIG. 6 is a partial close-up view of an arm of the flotation device of FIG. 1.
Figure 7:
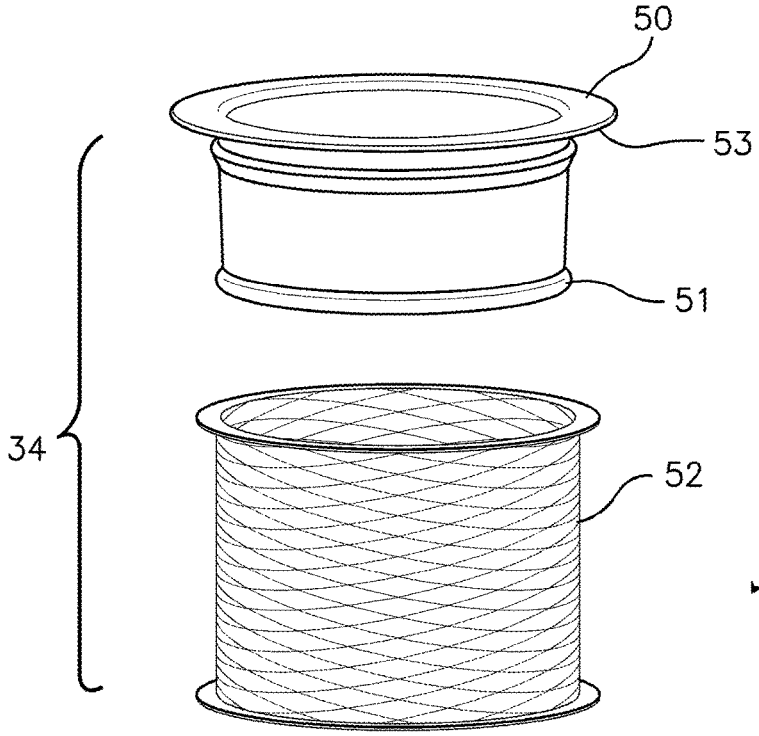
FIG. 7 is a partial close-up side view of a cupholder portion of the arm of FIG. 6.

Looking to FIGS. 2 and 6, an additional flotation support 43, 44 is included at the end of each arm 20, 22 to provide additional buoyancy to the end of the arms. As best seen in FIG. 6, the additional flotation support 43 is configured to conform to the shape of the enlarge portion of the end of the arm 20, with an aperture 55 corresponding to the cupholder aperture 33 in the arm 20 formed through the center of the flotation support 43 to allow the cupholder to be secured as previously described.

Figure 8:
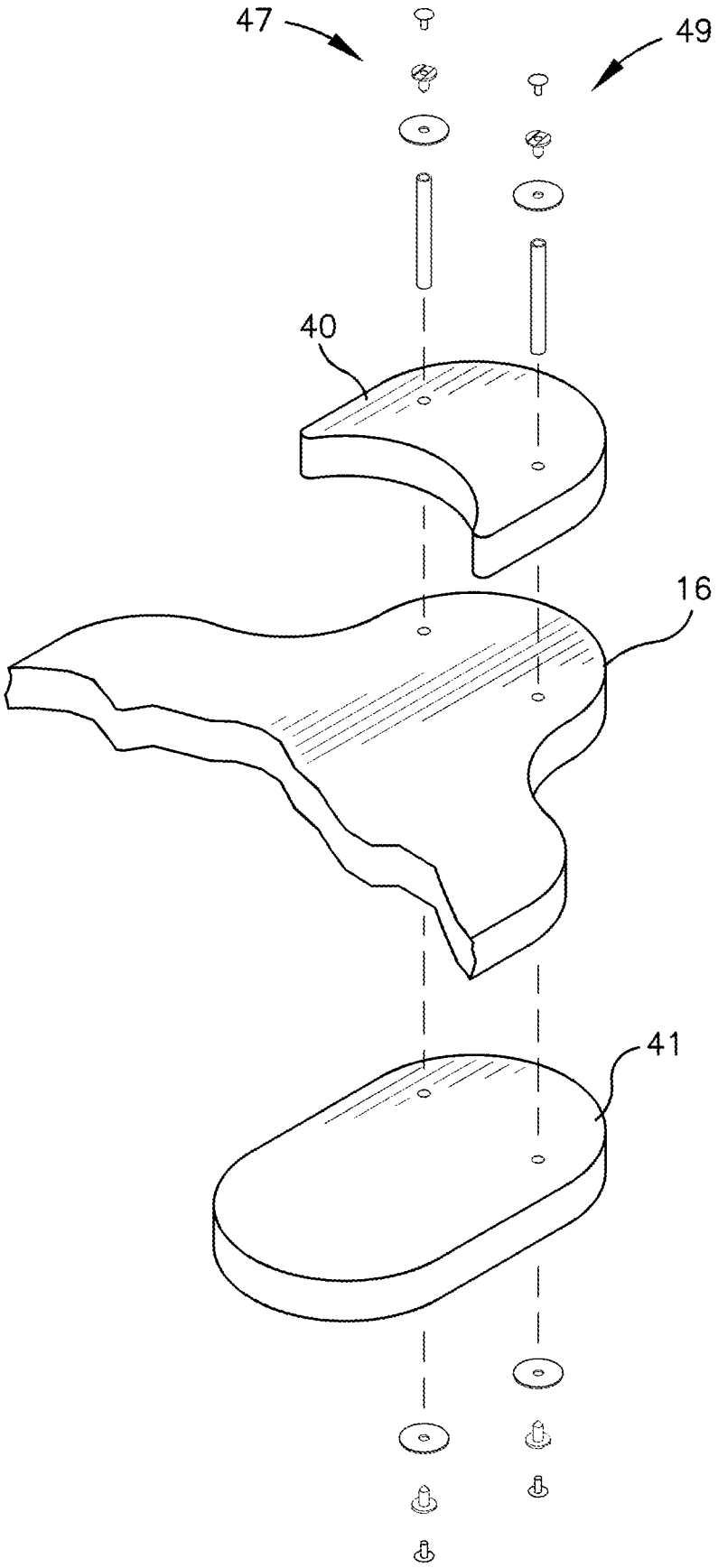
FIG. 8 is a partial close-up perspective view of the headrest portion of the flotation device of FIG. 1.

Looking to FIG. 8, first 40 and second 41 headrest extensions provide additional padding and additional buoyancy to the headrest portion 16. First headrest extension 40 is generally crescent shaped and second headrest extension 41 is generally oblong, with the first headrest extension 40 positioned against the top surface of the headrest portion 16 and the second headrest extension 41 positioned against the lower surface of the headrest portion 16. The curved upper and outer edge of each headrest extension conforms to the curved upper edge of the headrest portion 16. The first and second headrest extensions 40, 41 are attached to the headrest portion 16 using hinge assemblies 47, 49 which are attached through corresponding apertures in each of the headrest extensions 40, 41 and the headrest portion 16. The hinge assemblies 47, 49 are similar to the hinge assemblies 36, 38 used to attach the arms to the back rest as previously described. It should be understood that, as depicted in FIG. 8, with the headrest extensions 40, 41 attached to the headrest portion 16 using the two hinge assemblies 47, 49 that the headrest extensions are immovably, and not pivotably, attached to the headrest 16. The two headrest extensions 40, 41 provide additional buoyancy to the headrest 16 portion, with the first headrest extension 40 additionally providing additional elevated padding to the headrest portion 16 for user comfort.

As just described, it can be seen that the flotation device of the present invention is well adapted to overcome deficiencies of flotation devices known in the art. The flotation device of the present invention is lightweight and easily transportable and storable. The arms of the flotation device are adjustable in length to accommodate users of varying size and proportion, the arms further are pivotable with respect to the main body of the device to accommodate a user's desired positioning. A hinge assembly securely attaches the arms to the main body of the device while simultaneously allowing the arms to pivot. And, a cupholder positioned in the distal end of each arm is securely attached via a grommet having upper and lower protrusions which secure the cupholder in place through an aperture in the end of each arm.

It should be understood that while certain forms and embodiments have been illustrated and described herein, the present invention is not to be limited to the specific forms or arrangement of parts described and shown, and that the various features described may be combined in ways other than those specifically described without departing from the scope of the present invention. The terms "substantially", "generally", "approximately", or any other qualifying term as used herein may be applied to modify any quantitative representation which could permissibly vary without resulting in a change to the basic function to which it is related and if the variance does not materially alter the capability of the invention.

What is claimed is:

1. An adjustable flotation device, comprising:

a main body comprised of a buoyant material, for supporting a user in a body of water;

at least one arm pivotably attached at a first end to the main body such that a second outer end of the arm may be pivoted towards or away from the main body to adjust the angle of the arm with respect to the main body, wherein the at least one arm comprises a plurality of apertures formed through the first end, wherein each aperture allows attachment of the arm to the main body such that the arm extends a predetermined distance from the main body.

2. The adjustable flotation device of claim 1, wherein the arm is pivotably attached to the main body by a hinge mechanism which allows the arm to pivot with respect to the main body.

3. The adjustable flotation device of claim 2, wherein the hinge mechanism comprises a hinge tube and two push retainers configured to secure the hinge tube within the arm and main body.

4. The adjustable floatation device of claim 1, wherein the main body comprises a leg rest, a seat, a back rest, and a head rest.

5. The adjustable flotation device of claim 4, wherein the head rest comprises first and second headrest extensions position on upper and lower surfaces, respectively, of the head rest.

6. The adjustable flotation device of claim 1, wherein the arm comprises a flotation support attached to a lower surface of the arm.

7. The adjustable flotation device of claim 1, wherein the arm comprises a cupholder.

8. An adjustable flotation device, comprising:

a main body comprised of a foot rest, seat, back rest, and headrest; and first and second arms pivotably attached to opposite sides of the back rest, wherein each of the arms is independently pivotable towards and away from the back rest.

9. The adjustable flotation device of claim 8, wherein each arm is attached to the back rest via a hinge mechanism.

10. The adjustable flotation device of claim 9, wherein the hinge mechanism comprises a hinge tube and two push retainers configured to secure the hinge tube within the arm and main body.

11. The adjustable flotation device of claim 9, wherein each arm comprises a plurality of apertures formed through a first end, wherein each aperture allows attachment of the arm to the main body such that the arm extends a predetermined distance from the from the main body.

12. The adjustable flotation device of claim 9, wherein the head rest comprises first and second headrest extensions position on upper and lower surfaces, respectively, of the head rest.

13. The adjustable flotation device of claim 9, wherein each of the first and second arms comprise a flotation support attached to a lower surface of the arm.

* * * * *